US007578153B2

(12) United States Patent
Hedegaard

(10) Patent No.: US 7,578,153 B2
(45) Date of Patent: Aug. 25, 2009

(54) PELT DRYING ASSEMBLY COMPRISED OF A SLEEVE/BAG OF FAT AND MOISTURE ABSORBING MATERIAL AND A PELT BOARD

(75) Inventor: Jens Hedegaard, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 234 days.

(21) Appl. No.: 11/570,653

(22) PCT Filed: Jun. 14, 2005

(86) PCT No.: PCT/DK2005/000388

§ 371 (c)(1),
(2), (4) Date: Dec. 14, 2006

(87) PCT Pub. No.: WO2005/121381

PCT Pub. Date: Dec. 22, 2005

(65) Prior Publication Data

US 2008/0245116 A1 Oct. 9, 2008

(30) Foreign Application Priority Data

Jun. 14, 2004 (DK) ..... 2004 00918

(51) Int. Cl.
*C14B 17/00* (2006.01)

(52) U.S. Cl. ..... 69/19.1

(58) Field of Classification Search ..... 19/19.1, 19/19.2, 22, 23; 69/19.1, 19.2, 22, 23
See application file for complete search history.

(56) References Cited

U.S. PATENT DOCUMENTS

| | | | | | |
|---|---|---|---|---|---|
| 1,731,144 | A | * | 10/1929 | Lord | 69/19.2 |
| 2,362,062 | A | * | 11/1944 | Fishbeck | 69/19.2 |
| 3,137,963 | A | * | 6/1964 | Hein | 69/19.2 |
| 4,848,108 | A | * | 7/1989 | Thompson | 69/19.2 |
| 5,564,293 | A | * | 10/1996 | Black et al. | 69/19.2 |
| 6,701,756 | B2 | | 3/2004 | Hedegaard | |

FOREIGN PATENT DOCUMENTS

WO 86 00091 A1 1/1986

* cited by examiner

*Primary Examiner*—Shaun R Hurley
(74) *Attorney, Agent, or Firm*—David S. Safran; Roberts Mlotkowski Safran & Cole, P.C.

(57) ABSTRACT

A pelt drying assembly having a pelt board used in the drying of the leather side of a pelt which, in use, is applied to, stretched and secured on the distension element in the stretched position during drying, and a sleeve/bag made of fat and moisture absorbing material for covering the pelt secured in the stretched position by having been drawn over the fur side of the pelt so as to press the pelt against a holding area of the distension element. The sleeve/bag is tubular for drawing onto the pelt board from a pointed end thereof until it covers at least a part of the holding area on the distension element, and has a length equal to at least 1/3, preferably 1/2, of the length of the holding area of the distension element.

10 Claims, 3 Drawing Sheets

Figure 1:
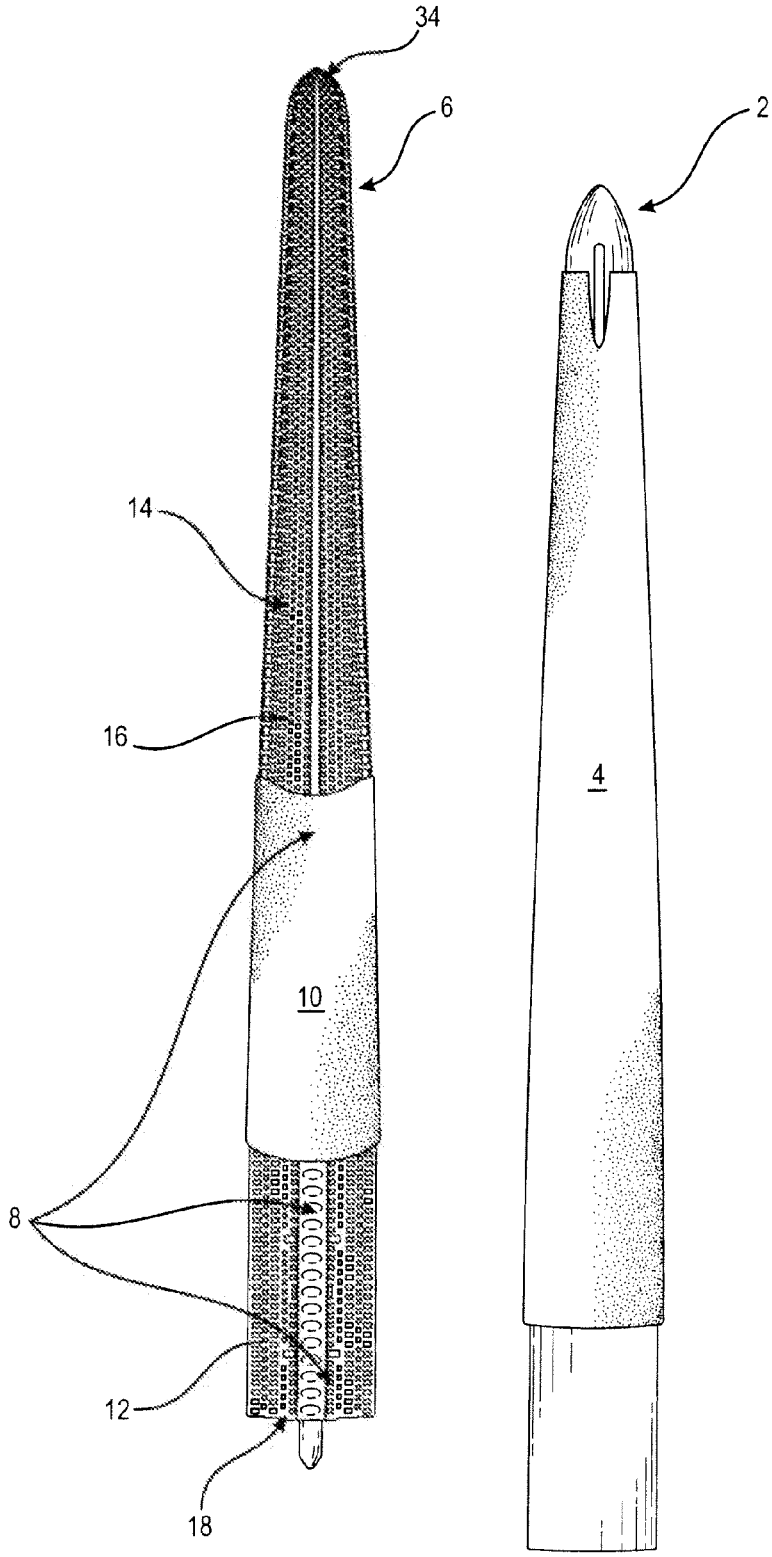

PELT DRYING ASSEMBLY COMPRISED OF A SLEEVE/BAG OF FAT AND MOISTURE ABSORBING MATERIAL AND A PELT BOARD

BACKGROUND OF THE INVENTION

1. Field of the Invention

The present invention relates to sleeve/bag item of fat absorbing material of the kind which is used for covering distension elements/pelt boards for use in the drying of the leather side of pelts which are stretched out on the distension element and secured in the stretched position during the drying procedure, and where the pelt is secured in the stretched position by means of a holding bag drawn over the fur side of the pelt, and which over at least a part of the lower end of the pelt presses the pelt against a holding area of the distension element, the distension element preferably comprising a hollow, oblong distension element which comprises at least a first and a second convex surface with an open structure, and where the holding area comprises a part-area of said surfaces where this is rough, corrugated or grooved.

2. Description of Related Art

The use of a fat absorbing sleeve/bag item for the covering of distension elements used in connection with the drying of pelts from furred animals is well known. The fat absorbing sleeve/bag item, which often is made of paper, serves to protect the distension elements, which often are made of wooden pelt boards. Use has earlier been made of ordinary newspaper for wrapping around the boards before providing the boards with pelts to be dried. However, the newspaper was difficult to remove after the drying of the pelts, and for this reason, there was later developed tubular-formed bags of paper intended to be drawn over the distension element/the board, as will appear from Utility Model BR 1996 00208. From the same utility model registration, it is also known to perforate the paper material of which the bags are made, the object being to improve the through-flow of air during the drying process.

In the mounting of pelts which are to be dried on the distension elements, a stretching of the pelts is carried out with the view to obtaining a good pelt, the size of which after the drying procedure is very important with regard to the sales price which can be fetched for the pelt. Thus in order to secure the pelt in its stretched position, use was made and is still made of 8-15 staples which are driven through the lower ends of the pelt and into the pelt board, whereby upon conclusion of the drying process the pelt substantially maintains that length to which it has been stretched. However, said staples leave holes in the pelt, which reduces its value. To avoid this problem, a method has been developed for the non-destructive drying of pelts, as disclosed in Danish Patent 174 865 B1, comprising a holding bag which, when the pelt is stretched on the pelt board, is drawn over the board with the inner bag and the pelt, so that the bag presses against the fur side of the pelt, whereby sufficient friction is generated to enable the number of staples to be reduced to two or none, which means that the pelt does not suffer any noteworthy damage (few holes in relation to earlier). Alternatively, if a pelt of a smaller size category can be accepted, that the pelt does not have any holes whatsoever from the use of staples.

However, the size category of a pelt which is used in the fur trade is very important with regard to the price which a fur farmer can obtain at a fur auction. Merely a single size category can involve large amounts in earnings for a fur farmer, which is why further developments of the technique in the drying of pelts have been undertaken with the object of obtaining both a larger size category of the dried pelt as well as pelts without holes resulting from the use of staples for securing the pelt in the stretched position on the pelt board during the drying procedure. The problem with the use of the known boards of wood, which are made of a flaftish, conical board, in combination with a holding bag as disclosed in DK 174 865 B1 and corresponding U.S. Pat. No. 6,701,756, is that the holding bag generates friction for the securing of the pelt mainly in the areas around the narrow sides of the board, i.e., the pressure arising from the holding bag on the broad side surfaces of the board is negligible, whereby the pelt around the tail root, the back skin can creep during the drying procedure, and therefore, use is made of the above-mentioned two staples for securing the pelt in these areas.

In order to solve this problem, there has been developed a pelt board which has a convex structure in both the longitudinal and transverse direction as well as in the height direction, which typically is formed of two mutually connected convex half-shells of plastic with an open/perforated structure, the peripheries of which define a cavity along the sides which, via an opening at the foot of the board, stands in connection with an arrangement (not described in more detail here) for the replacement of the air inside the board in connection with the drying procedure. The half-shells comprise a holding area where the surfaces of the half-shells on the side facing the leather side of the pelt comprise a corrugated/slotted/grooved or other roughness oriented substantially transversely to the longitudinal axis of the distension element, whereby the pressure exerted by the holding bag over a smaller area of the distension element is made more effective as a result of the greater friction generated, in that the leather side is pressed by the holding bag against the corrugated/slotted/grooved parts or other roughness existing in the holding areas.

This has led to efforts being made to stretch the pelts to even larger size categories, whereby the problem of securing the pelt around the tale root has again become relevant. Moreover, in practical trials with the holding bag in combination with the newly-developed distension element/pelt board, it has proved that the strong pressing of the leather side of the pelt against the holding areas has the result that the parts of the leather side of the pelt in contact with the distension element/pelt board are not sufficiently dried during the drying procedure, whereby there occurs a form of decaying of the pelt which hereby becomes black, and there also occurs a condensation of the moisture extract on the fur side of the pelt, which is naturally undesirable. This problem is pronounced, namely, in connection with pelts which are thick in the leather and with pelts which are badly scraped. In the solution to this problem, operations could be effected with the use of the previously-known covering bag, which extends substantially over the whole length of the distension element, but this will be quite superfluous since the structure of the newly-developed pelt board otherwise permits a much more effective/quick drying of the pelts than was possible earlier with the use of pelt bags on wooden boards, whereby use of such pelt bags would presumably solve the problem, but will result in an undesired extension of the drying time for the pelts. Moreover, the presence of a pelt bag around the places on the pelts where this lies in three layers will constitute a hindrance for an optimal through-flow of air and herewith the drying of this area of the pelt.

SUMMARY OF THE INVENTION

With the invention it has been realized, however, that the above-noted problems concerning insufficient securing of the pelt around the tail part and inadequate drying of the leather side of the pelt in the holding area, can be solved by using a pelt board of the kind disclosed by way of introduction, in which the pelt bag is formed of a tubular sleeve/bag item to be drawn onto and over the distension element/pelt board from its pointed end, for covering of at least a part of the holding area on the distension element, the extent of said pelt bag corresponding at least to ⅓, but preferably one half, of the extent of the holding area on the distension element.

A greater frictional force is thereby achieved between the leather side of the pelt and the holding area of the pelt board, the result being that after conclusion of the drying procedure, a straight measuring line is obtained at the lower ends of the pelt around the tail part, while at the same time the moisture which has collected in the leather side of the pelt in the holding area, and more precisely, where the pelt is pressed in contact with the actual surface of the distension element, by the capillary effect of the fat and moisture absorbing material, can be removed by changing the air in the cavity which is defined by the half-shells. The moisture is drawn out by the fat/moisture absorbing material, during which said replacement of the air is effected, whereby the above-mentioned decaying of the pelt, which hereby turns black, and moisture extract on the fur side of the pelt is effectively avoided.

A further advantage of the use of the pelt bag according to the invention is that it further absorbs residual fat on the leather side of the pelt in the holding area, the result being that this area of the distension element/pelt board is not made "greasy," which it otherwise would be with reduction of the frictional forces as a consequence, and this area of the board does not become greasy, which means that the pelt board becomes easier to handle.

Moreover, a sleeve/bag with such a relatively short length in relation to the known bags will be able to be sold at a reduced price, and the bag is easier to remove from the board and the pelt after drying has been concluded.

A further advantage of the bag according to the invention is that its length is considerably less than the known full-length bags, which will facilitate an automation of the application of the bags on the boards, namely in places where there is relatively low room height.

With the object of creating an increased flow of air through the pelt bag/sleeve according to the invention, the bag/sleeve can be formed of a perforated, fat and moisture absorbing material.

With the object of being able to produce a pelt bag according to the invention at a competitive price, the fat and moisture absorbing material can be paper.

With the object of achieving an effective extraction of fat and moisture from the leather side of the pelt, the pelt bag can have a conical shape so that, by drawing down from the pointed end of the distension element towards the foot end, the pelt bag can be brought into contact with relevant parts of the holding areas of the distension element. It is hereby achieved that the pelt bag according to the invention remains in its place in the holding area on the distension element during the stretching of the pelt.

In the following, the invention is explained in more detail with reference to the accompanying drawings.

BRIEF DESCRIPTION OF THE INVENTION

Figure 2:
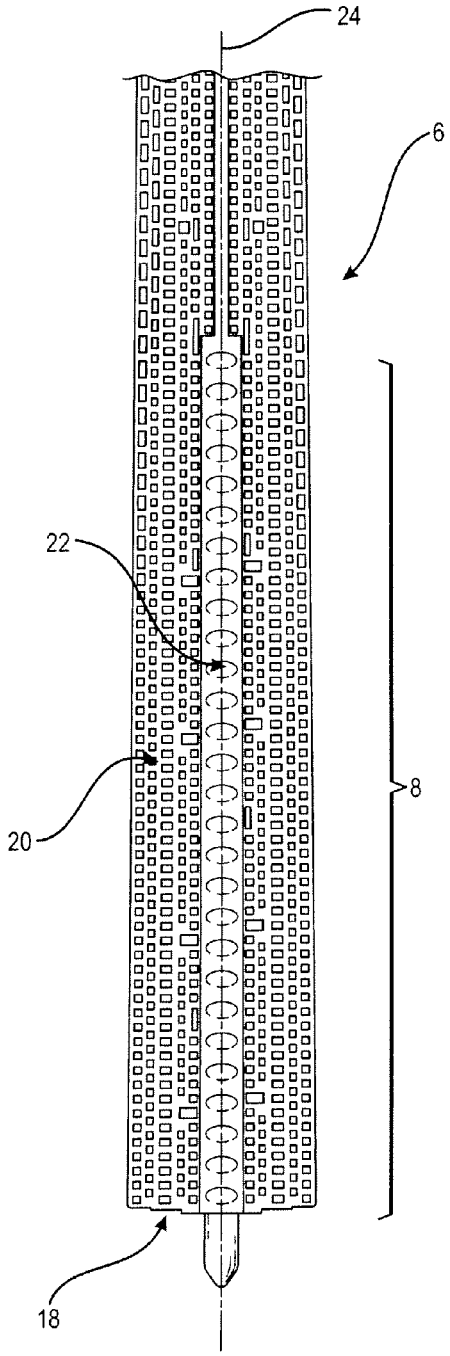
Figure 3:
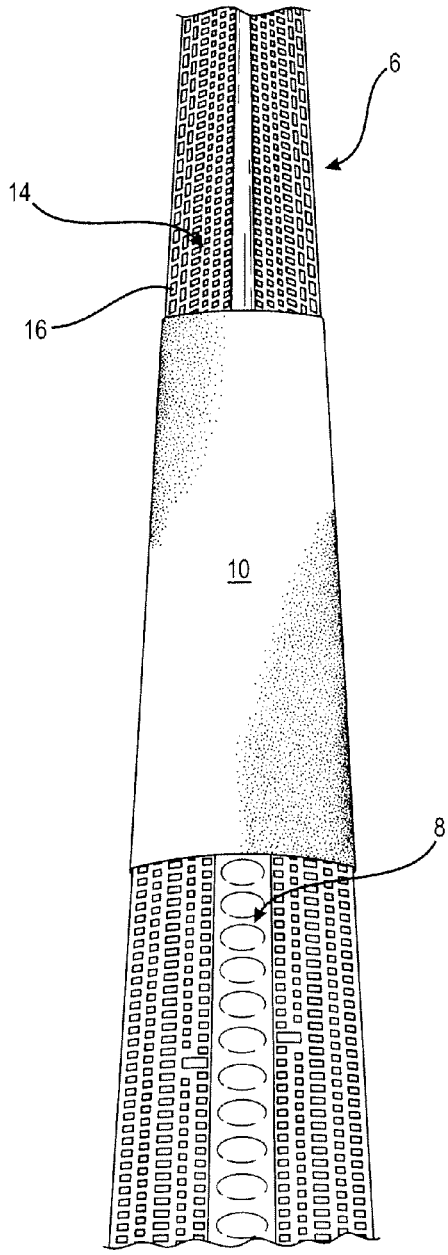
Figure 4:
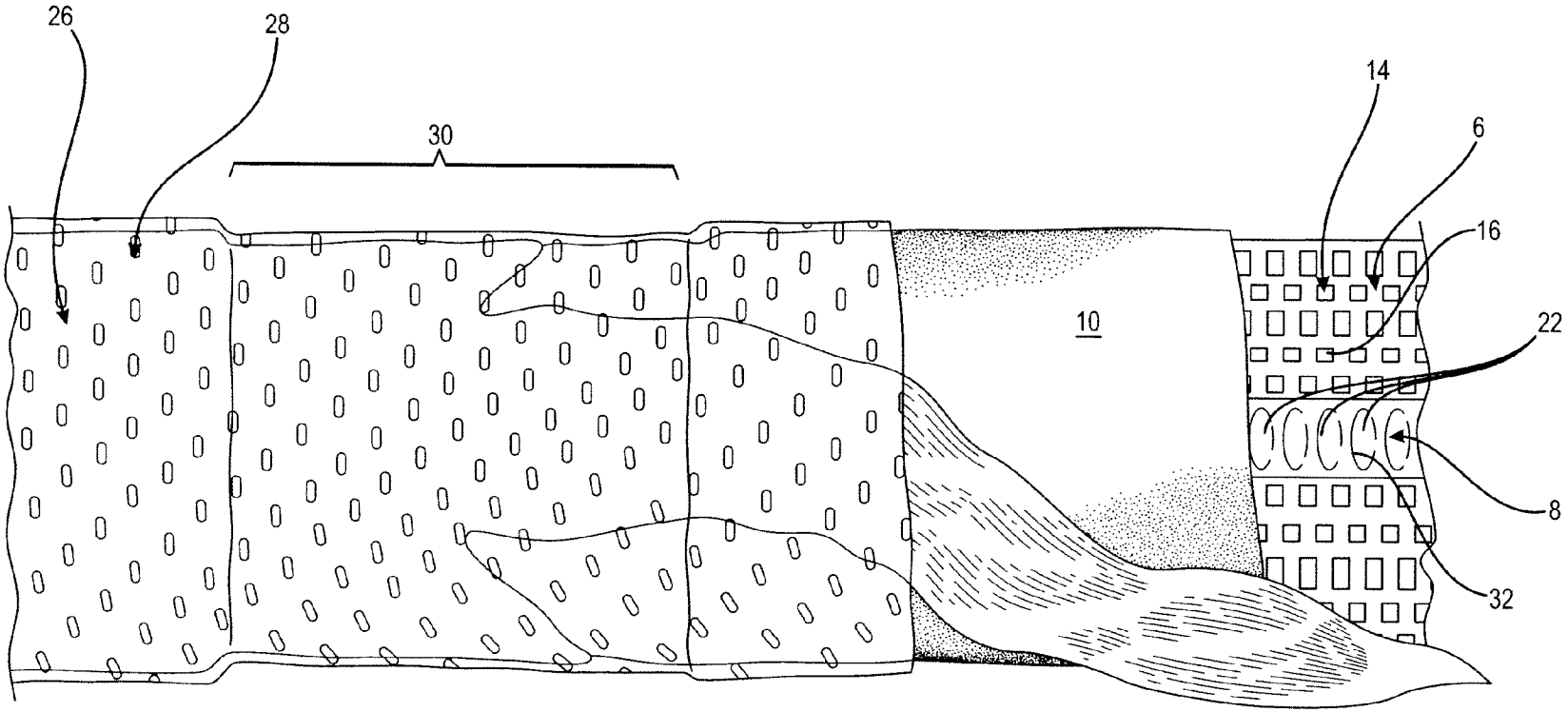

FIG. 1 is a side view of a traditional pelt board over which a pelt bag has been drawn, and a modern pelt board with holding areas which are partly covered by a pelt bag according to the invention, FIG. 2 is a detail view of the lower end of a modern pelt board, showing the foot of the board and the holding area, FIG. 3 is a detail view of a part of a modern pelt board, showing the holding area provided with a pelt bag according to the invention, and FIG. 4 is a detail view of the pelt board shown in FIG. 3, on which a pelt has been applied and stretched and secured with an overdrawn holding bag.

DETAILED DESCRIPTION OF THE INVENTION

In FIG. 1 are shown examples of two types of distension elements/pelt boards. To the right is shown a traditional board 2 over which a known pelt bag 4 has been drawn which, in the illustrated embodiment, is made of fat absorbing paper. To the left is shown a modern distension element/pelt board 6 comprising a holding area 8, which is partly covered by a pelt bag 10 according to the invention. The modern board 6 is formed of two convex half-shells 12 joined together, with surfaces 14 which have a very open structure in the form of holes 16. Together, the half-shells 12 define a cavity which is open at the foot 18 of the distension element/pelt board 6.

FIG. 2 is a detail section of the distension element/pelt board 6, showing the lower end of the board 6 and the foot end 18. As is seen in the figure, in this embodiment of the board 6, the holding area 8 is formed by a part of the board nearest to its foot end 18, where the surfaces of the half-shells have a corrugation 22 extending along the longitudinal axis 24 of the board.

FIG. 3 shows a section of the distension element/pelt board shown in FIG. 2, where a part of the holding area 8 is covered by a pelt bag 10 according to the invention.

FIG. 4 shows the pelt bag 10 according to the invention in use. The picture shows the lower end of the distension element/pelt board 6 in the holding area 8, where the distension element/pelt board 6 is first provided with an overdrawn bag 10 of fat and moisture absorbing material, in the illustrated embodiment, perforated (not shown) paper. Over the pelt bag 10, on the distension element/pelt board 6, there is drawn and stretched a mink pelt 26 which is secured in its position by a drawn-on holding bag 28 of perforated plastic. As is apparent in FIG. 4, the holding bag 28 comprises an area 30 near its end where the inside diameter of the bag is less than the remaining parts of the overdrawn holding bag 28. In this area 30, the fur side of the mink pelt 26 is pressed in the direction of the distension element/pelt board 6, whereby the leather side (not shown) of the pelt is pressed against the pelt bag 10 with relatively great force, so that both the pelt bag and the leather side of the pelt are pressed down in the recesses 32 in the corrugations 22 in the holding area 8, whereby there is achieved an effective securing of the stretched pelt 26 during the consequent drying process, which takes place by changing of the air inside the cavity of the distension element/pelt board, typically by the blowing of air through the opening to the cavity in the foot of the board 18. The blown-in air is diffused out through the holes 16 in the area of the board at the jaw part 8 (not shown) of the pelt, which lies at the opposite end, pointed or top end 34, cf. FIG. 1.

The effect of the pelt bag 10 according to the invention is that residual fat and moisture will be drawn out by the fat and moisture absorbing material, i.e., the paper. The moisture will evaporate and be led away by the replacement of the air in the cavity below the holes 16 under the paper/the bag 10 inside the distension element/pelt board 6. The bag 10 thus functions like the old known blotting paper.

With the absorption of the residual fat from the leather side of the pelt by the bag 10 according to the invention, there is achieved a better frictional force between the holding area 8 and the stretched pelt 26, which is hereby secured in its stretched position during the drying process.

The bag 10 can, with advantage, also be made of perforated paper, which will contribute towards an increase in the transporting of moisture away from the paper.

In the illustrated embodiment, the bag 10 is conical in shape, corresponding to the conical shape of the distension element/pelt board 6. The pelt bag 10, which is considerably shorter than the traditionally-known pelt bags, cf. FIG. 1, is intended to be drawn over the distension element/pelt board 6 from the pointed end 34 with the largest opening diameter facing the foot 18 of the board. The bag is drawn down over the distension element/pelt board 6 until it wedges firmly on the outer side surface in the holding area 8, where it covers a part of this area. In an unillustrated embodiment, the pelt bag can be constructed so that it covers the whole of the holding area 8. However, the illustrated embodiment is preferred in that the length of this pelt bag is dimensioned to enable it to be used for pelts of most sizes.

What is claimed is:

1. Pelt drying assembly comprising a pelt board used in the drying of the leather side of a pelt which, in use, is applied to, stretched and secured on the pelt board in the stretched position during drying, an inner sleeve/bag of fat and moisture absorbing material for covering a portion of the pelt board between a leather side of the pelt and pelt board and a outer sleeve/bag made of fat and moisture absorbing material for covering the pelt secured in the stretched position by having been drawn over the fur side of the pelt so as to press the pelt against the inner sleeve/bag on a holding area of the pelt board, wherein the inner sleeve/bag is tubular for drawing onto the pelt board from a pointed end thereof until it covers at least a part of the holding area on the pelt board, and wherein said inner sleeve/bag has a length equal to ⅓ to ½ of the length of the holding area of the pelt board.

2. Pelt drying assembly according to claim 1, wherein said pelt board comprises a hollow, oblong distension element having a first and a second convex surface with an open structure, and where the holding area comprises a part area of said surfaces which is one of rough, corrugated and grooved.

3. Pelt drying assembly according to claim 1, wherein the sleeve/bags are perforated.

4. Pelt drying assembly according to claim 2, wherein the fat and moisture absorbing material is paper.

5. Pelt drying assembly according to claim 2, wherein the fat and moisture absorbing material is paper.

6. Pelt drying assembly according to claim 5, wherein the inner sleeve/bag has a conical shape corresponding to the shape of the pelt board so that, when drawn down from the pointed end of the pelt board towards a foot end, the sleeve/bag can be brought into contact with the holding area of the pelt board.

7. Pelt drying assembly according to claim 1, wherein the inner sleeve/bag has a conical shape corresponding to the shape of the pelt board so that, when drawn down from the pointed end of the pelt board towards a foot end, the sleeve/bag can be brought into contact with the holding area of the pelt board.

8. Pelt drying assembly according to claim 7, wherein the fat and moisture absorbing material is paper.

9. Pelt drying assembly according to claim 1, wherein the inner sleeve/bag has a conical shape corresponding to the shape of the pelt board so that, when drawn down from the pointed end of the pelt board towards a foot end, the sleeve/bag can be brought into contact with the holding area of the pelt board.

10. Pelt drying assembly according to claim 3, wherein the inner sleeve/bag has a conical shape corresponding to the shape of the pelt board so that, when drawn down from the pointed end of the pelt board towards a foot end, the sleeve/bag can be brought into contact with the holding area of the pelt board.

* * * * *